US005524713A

United States Patent [19]

Lange

[11] Patent Number: 5,524,713

[45] Date of Patent: Jun. 11, 1996

[54] DRILL RIG HAVING ALTERNATE SPINDLE DRIVE

[76] Inventor: James E. Lange, P.O. Box 1670, LaPorte, Ind. 46350

[21] Appl. No.: 283,796

[22] Filed: Aug. 1, 1994

Related U.S. Application Data

[63] Continuation-in-part of Ser. No. 53,544, Apr. 26, 1993, Pat. No. 5,360,072.

[51] Int. Cl.[6] ..... F21B 3/02

[52] U.S. Cl. ..... 173/2; 173/213; 173/216; 173/222

[58] Field of Search ..... 173/2, 13, 213, 173/216, 217, 222, 214; 408/241 G, 710; 74/613; 409/134

[56] References Cited

U.S. PATENT DOCUMENTS

| | | | |
|---|---|---|---|
| 2,612,347 | 9/1952 | Siracusa | 173/216 |
| 3,390,728 | 7/1968 | Bartos | 173/213 |
| 3,437,158 | 4/1969 | Proffer | 173/213 |
| 3,472,557 | 10/1969 | Hlinsky | 173/216 |
| 3,766,995 | 10/1973 | Young et al. | 173/216 |
| 5,029,655 | 7/1991 | Ebeling | 173/216 |
| 5,437,338 | 8/1995 | Martin et al. | 173/222 |

*Primary Examiner*—Scott A. Smith
*Attorney, Agent, or Firm*—Baker & Daniels

[57] ABSTRACT

A drill rig includes a main engine which drives a drilling spindle through a clutched transmission. A protective cage surrounds the spindle when the transmission is in gear to prevent workmen from being injured by drilling tools. An auxiliary drive motor operates the spindle for a limited number of revolutions when the transmission is in neutral and the protective cage is open to permit workmen to rotate the spindle to add and remove augers, couple and uncouple drilling rods, and perform other necessary tasks.

12 Claims, 4 Drawing Sheets

DRILL RIG HAVING ALTERNATE SPINDLE DRIVE

This is a continuation-in-part of U.S. patent application Ser. No. 08/053,544, filed Apr. 26, 1993, now U.S. Pat. No. 5,360,072.

This invention relates to a drill rig having an auxiliary drive motor in addition to the main drive engine for driving the drilling spindle.

Commercial drilling operations generally use drill rigs mounted on the back of a truck. These drilling rigs include a drilling spindle, to which an earth boring auger and/or other tools are coupled, a main drive engine for operating the drilling spindle, and a clutch, transmission, right angle drive and rotary box for coupling the main drive engine to the drilling spindle. The drilling spindle is mounted for rotation in a drilling head which can be moved vertically with respect to the drill rig to perform the drilling operation. In addition to commonly used earth boring tools, the drill rig can be used for other tasks, such as setting well casing. As discussed in the above-identified allowed U.S. patent application Ser. No. 08/053,544, accidents are common around drilling equipment, since operators may easily come in contact with the rotating drilling tools. Accordingly, according to the prior application, a drilling barrier surrounds the drilling tools, which must be latched in place before the transmission can be shifted into a driving gear. The barrier may be opened only when the transmission is in neutral.

It is, however, desirable to permit limited rotation of the drilling spindle when the drilling barrier is open. For example, it is desirable for the drilling spindle to be rotated for 1–2 revolutions at high torque and low speed in order to break the rods or other drilling implements loose from the drilling spindle or to align the spindle with the augers. This must be done with the safety barrier open, as it is necessary for workmen to have access to the drilling tools, but as long as rotation of the spindle is limited to a few revolutions, no significant injury can occur. Furthermore, it is desirable that the spindle be rotated at a lower torque, but at a higher speed, for several revolutions to perform other tasks, such as the joining or separating rods that are threaded together which is a tedious job, which can be more quickly accomplished if the driving power of the drilling spindle is available. Again, it is necessary for this task to be performed with the safety barrier open.

The present invention provides an auxiliary drive motor which is coupled to the drive shaft connecting the transmission with the gear box, or elsewhere in the drive line. The auxiliary drive motor is a hydraulically driven reversible motor connected through a two speed gearbox to the drive shaft. Accordingly, the auxiliary motor is able to drive the spindle in either direction, at either of two speeds. A timer and an on/off switch are provided to control communication of hydraulic fluid to the motor. The switch is operated by the operator of the rig, and the timer permits operation of the auxiliary drive motor for only a few seconds at a time. If the gearbox is in the low speed range, the timer permits the spindle to be driven for about one revolution. If the gearbox is in the high speed range, the timer permits the spindle to be driven for about four revolutions. The transmission must be in neutral for the auxiliary motor to be used. Accordingly, the safety barrier may be opened to permit access to the drilling spindle and drilling tools. Therefore, one important advantage of the present invention is that the drilling spindle, with the main drive transmission in neutral and drilling cage open, may be operated for approximately one revolution at high torque, for example, to align augers or other tools from the drilling spindle. Another important advantage of the present invention is that the drilling spindle may be operated in either direction for a few revolutions at a speed higher than the lower speed range to assist in, for example, coupling threaded rods.

These and other important advantages of the present invention will become apparent from the following description, with reference to the company drawings, in which:

FIG. 4 is a view of the drive line of the drill rig of

Figure 1:
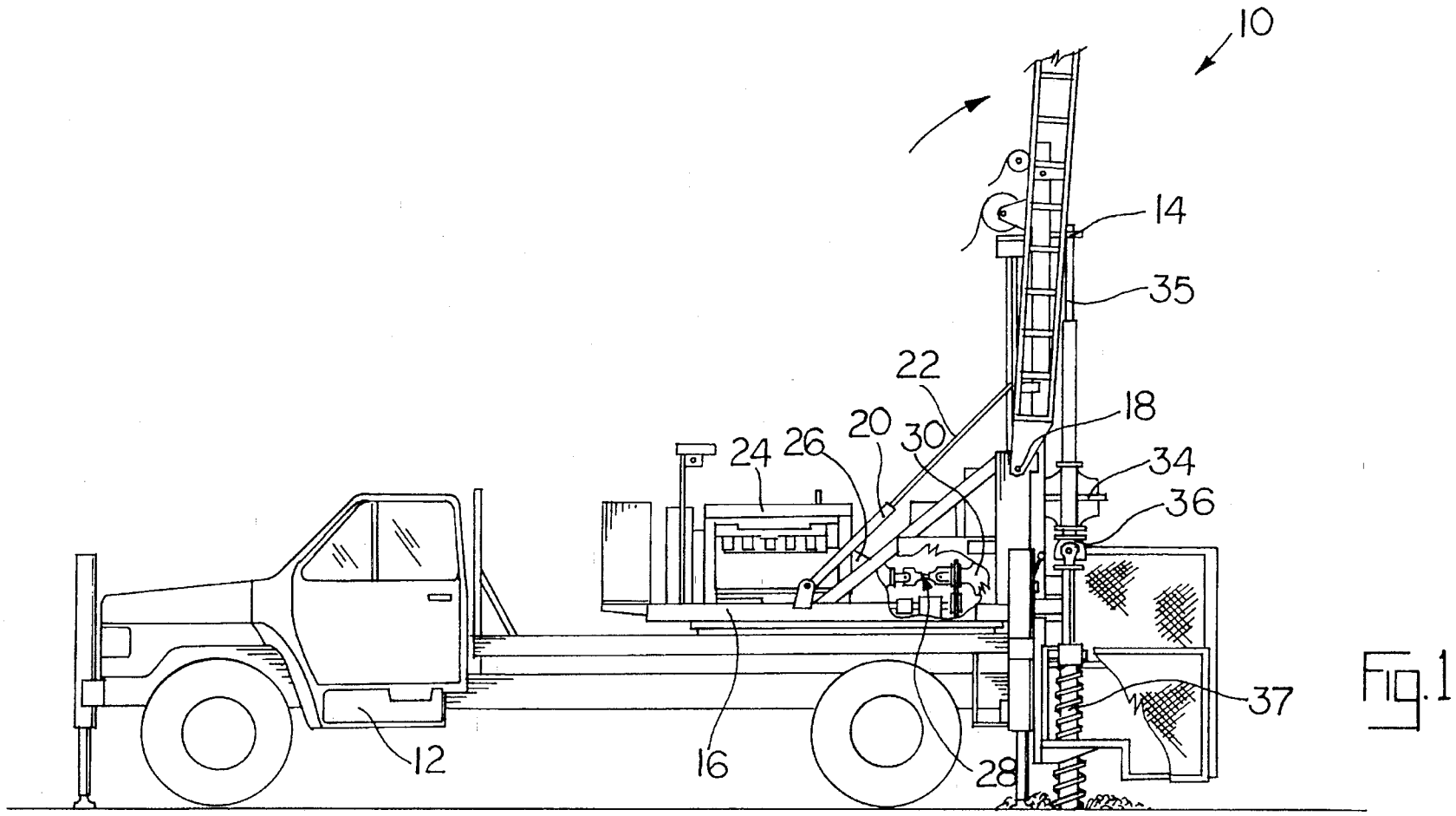
FIG. 1 is a side elevational view of a drill rig having an alternate spindle drive motor according to the present invention.
Figure 2:
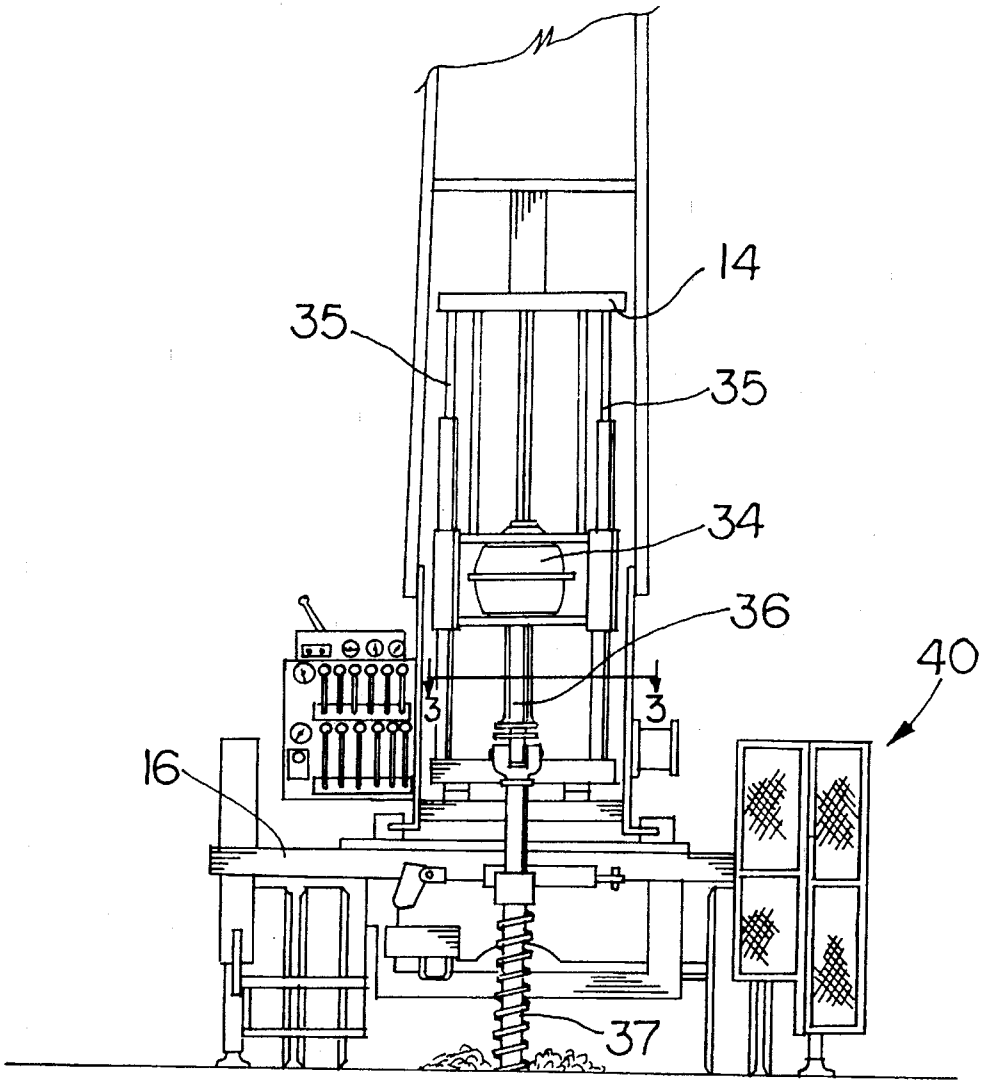
FIG. 2 is a rear view of the drill rig illustrated in FIG. 1.
Figure 3:
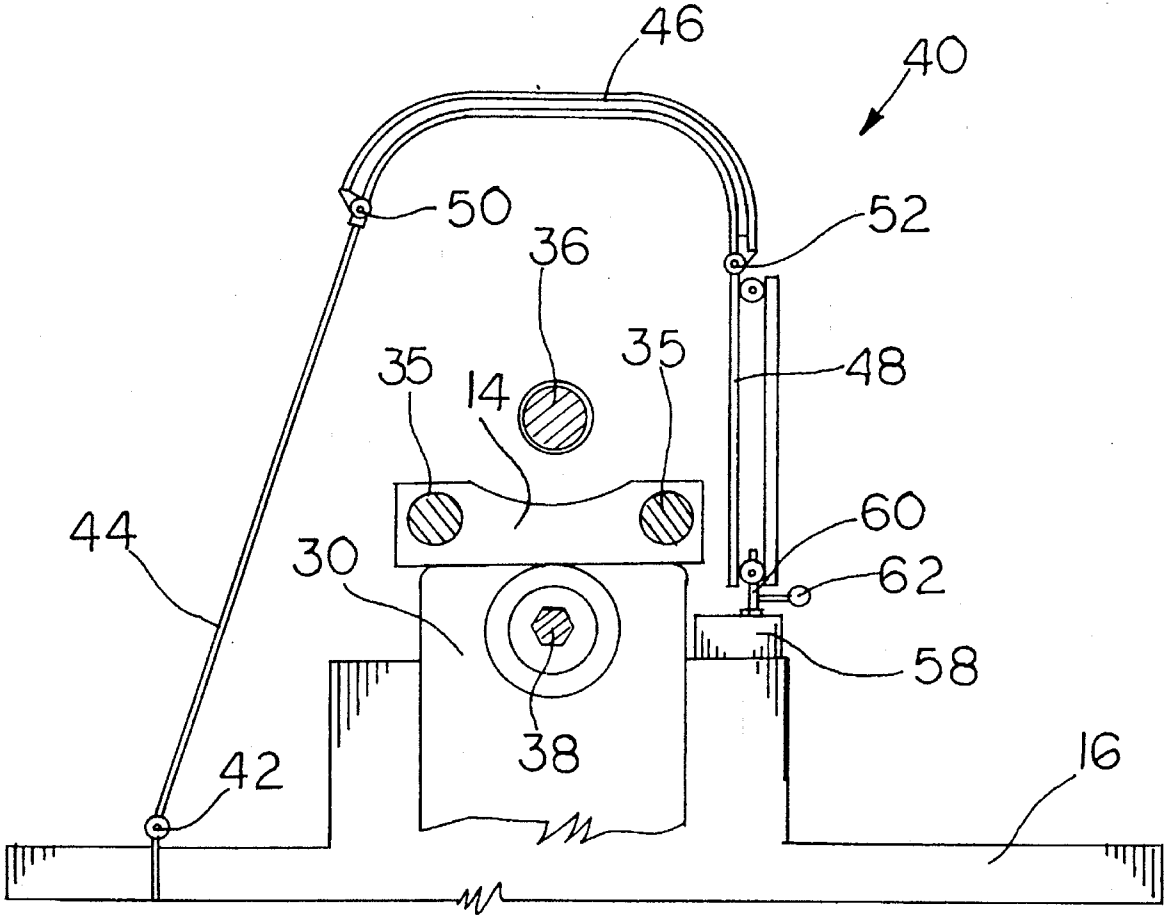
FIG. 3 is a view taken along line 3—3 of FIG. 2.
Figure 4:
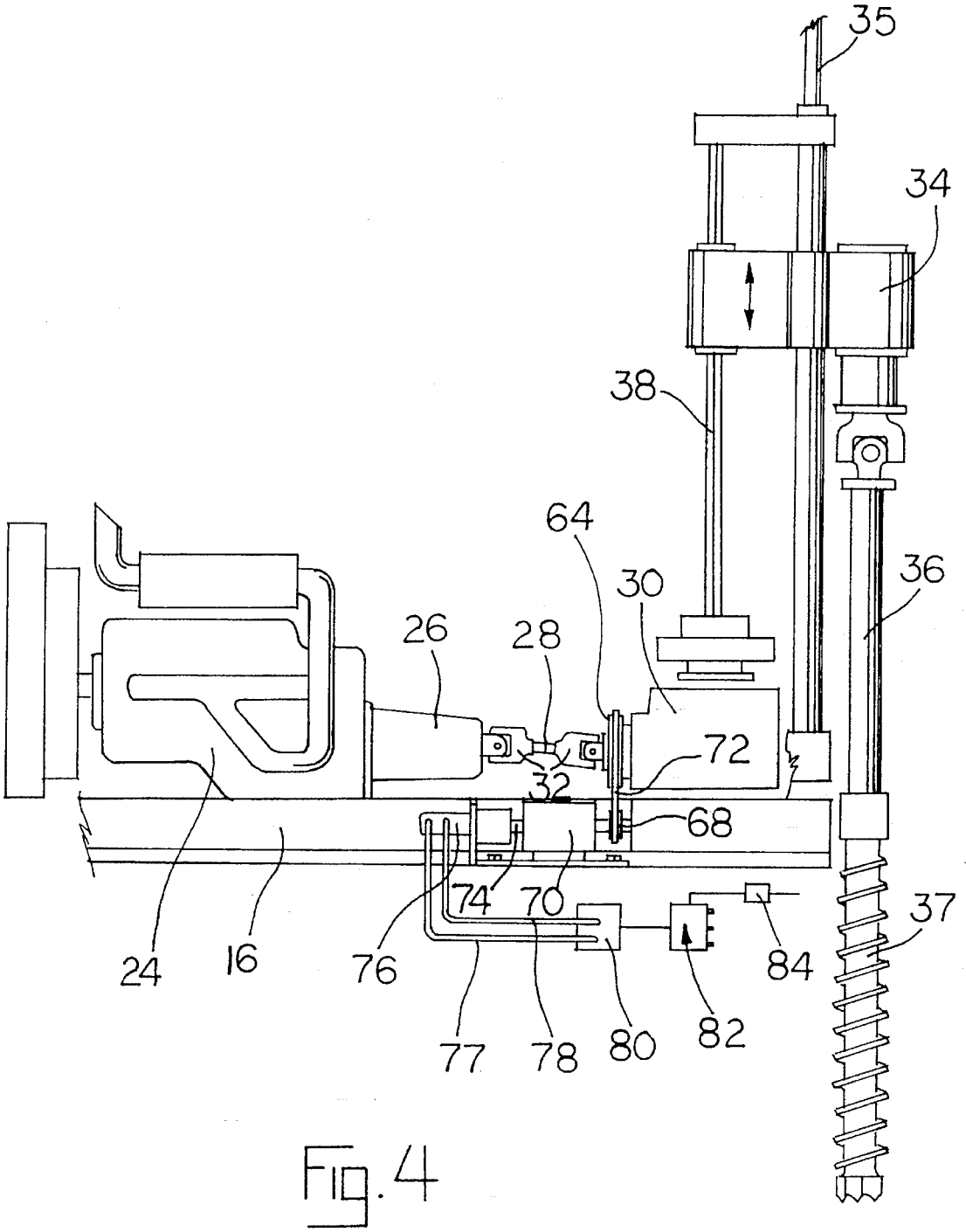

FIGS. 1 and 2 which incorporates the alternate spindle drive of the present invention.

Referring now to the drawings, a drill rig generally indicated by the numeral 10 is illustrated as being mounted on a flatbed truck 12. Drill rig 10 includes a feed frame 14 which is mounted on rig support frame 16 by pivots 18. A hydraulic cylinder generally indicated by the numeral 20 includes an extensible arm 22 pivotally connected to spindle support frame 14, so that spindle support frame 14 can be pivoted about pivot 18 between its operative position illustrated in the drawing and its lowered position in which spindle support frame 14 is substantially horizontal to thereby permit the truck 12 to be driven on the public highways. An engine 24 is mounted on rig support frame 16 and drives a transmission 26 which is also mounted on rig support frame 16. The transmission 26 is a conventional transmission and is shiftable between neutral and one or more driving gears. A drive shaft generally indicated by the numeral 28 connects the transmission 26 with a right angle drive gearbox 30, which is also mounted on the rig support frame 16. The drive shaft 28 includes universal joints 32.

A rotary box 34 is slidably mounted on feed frame 14 and is slidable therealong by hydraulic pistons 35. Drilling head 34 includes a drilling spindle 36 which may be coupled to appropriate drilling tools, such as augers (not shown) for earth boring or may be used to set well casings. The rotary box 34 is driven by a kelly bar 38 coupled to the right angle drive 30 which in turn transmits power to the spindle 36 through the rotary box 34 by using gears or sprockets and chains within the rotary box 34.

As more fully described in the aforementioned co-pending U.S. patent application Ser. No. 08/053,544, the rotary box 34, the drilling spindle 36, and any tools attached thereto (such as auger 37) are protected by a safety barrier generally indicated by the numeral 40 to prevent workmen from being injured by drilling tools during normal drilling operations. The safety barrier 40 is connected to the drill rig 10 at a pivot point 42 and consists of three articulated sections 44, 46, and 48 which are connected respectively by pivot pins 50 and 52. As illustrated in FIG. 1, each of the sections 44, 46, and 48 consist of upper and lower telescoping sections, the lower sections 54 and 56 which telescope with the sections 46 and 48 being illustrated in FIG. 1. Accordingly, the sections can be telescoped together for road travel, but are deployed as illustrated during drilling operations. Support frame 16 further includes a keybox 58 which is configured to accept a key 60 which is controlled by handle 62. Electronic sensors (not shown) within the keybox 58 sense the presence of key 60, so that driving of spindle 36 is enabled only when the key is received within the keybox. When the transmission is shifted into neutral, the key may be withdrawn from the keybox and the safety barrier opened.

A pulley or sprocket 64 is fixed to the drive shaft 28 and is connected to another pulley or sprocket 66 on the output shaft 68 of a conventional, two speed gearbox 70 by a drive belt or chain 72. The input 74 to the gearbox 70 is coupled to a conventional reversible hydraulic motor 76. The gearbox 70 is shiftable between neutral, in which the hydraulic motor 76 is disconnected from drive shaft 28, and both high and low speed ranges. A pair of hydraulic lines 77, 78 are connected to a four-way, three-position solenoid valve generally indicated by the numeral 80. The solenoid valve 80 is provided with corresponding connections (not shown) to the outlet of a conventional hydraulic pump when (not shown) and to a reservoir (not shown) at the inlet of the pump. The pump may be any conventional hydraulic pump, and may be, for example, driven off of the engine 24. The solenoid valve 80 is conventional, and is shiftable from a normal or neutral position in which both of the lines 77, 78 are communicated to the aforementioned reservoir, to a first actuated position in which line 78 is communicated to reservoir and line 76 is communicated to the outlet of the pump, and to a second actuated condition in which line 77 is connected to reservoir and line 78 is connected to the outlet of the pump. The operation of the solenoid valve 80 is in all respects conventional and will not be described in detail herein.

The solenoid valve 80 is controlled by a double pole, double throw toggle switch generally indicated by the numeral 82. The toggle switch 82 is shifted between a normal off position to a first actuated condition which causes the valve 80 to communicate line 78 to the pressure at the outlet of the pump, and from the neutral off position to a second actuated condition which communicates the line 77 to the outlet of the pump. In both instances, the other line 77 or 78 not communicated the pump is communicated to reservoir. A conventional timer 84 interrupts power to the valve 80 thereby causing it to return to its neutral condition at a predetermined time interval after the toggle switch 82 has been moved to either of the actuated positions. For example, the period of the timer 84 may be about five seconds, which limits the number of revolutions of the drilling spindle 36 powered by the hydraulic motor 76 to that number of revolutions which can be effected in five seconds.

In operation, normal driving operation of the drilling spindle 36 by the engine 24 is permitted only when the key 60 is sensed within the keybox 58. When the key 60 is within keybox 58, the transmission may be shifted out of neutral and into one of the driving gears, thus permitting normal drilling operation of the drilling spindle 36. During normal drilling operation, the hydraulic motor 76 is disconnected from the drive line by shifting gearbox 70 into neutral.

When it is necessary to couple and uncouple drilling tools, transmission 26 is shifted into neutral, thus disconnecting the engine 24 from its driving connection with the drilling spindle 26. Accordingly, the key 60 may be removed from the keybox 58 and the safety barrier 40 opened, permitting workmen access to the drilling head 34 and the tools connected thereto. Uncoupling drill rods may be difficult, and it is desirable to apply a high torque to the drilling spindle 36 in the counterclockwise direction to therefore break loose the threaded connection between the rods. Accordingly, the toggle switch 82 is moved to the position causing driving of the hydraulic motor 76 in the counterclockwise direction. The solenoid valve 80 responds to switch 82 by moving to the actuated position in which the corresponding hydraulic line 77 or 78 which causes rotation of the hydraulic motor 76 in the counterclockwise direction as connected to the outlet of the aforementioned pump. Before the toggle switch 82 is operated, the gearbox 70 is shifted into the low speed range. When the toggle 82 is operated, the timer begins timing, thereby effectively allowing operation of the hydraulic motor 76 for a relatively short time period. This relatively brief time period is selected to be equal to that required to effect about one revolution of the drive spindle 36 when the gearbox is in the low speed range, Accordingly, maximum torque is available to break loose the threaded connection between drilling tools. The high torque/low speed is also used to align the auger connection with the drive spindle as augers are added.

When rods are added it is desirable to rotate the drilling spindle 36 for a limited number of rotations sufficient to thread the sections of casing together. Accordingly, the gearbox 70 is shifted into the high speed range, and the switch 82 is moved to the position causing the solenoid valve 80 to communicate the hydraulic line 77 or 78 effecting clockwise rotation of the hydraulic motor 76 to the pump outlet. The timer 84 permits power to the solenoid valve 80 for the predetermined time period. Since the gearbox has been moved into the high speed range, this limited time period permits about four revolutions of the spindle 36, thereby permitting joining the rods together. If it is desired to separate rods or perform other work requiring counterclockwise operation of the spindle 36 for multiple revolutions, the switch 82 can be moved to the position effecting a counterclockwise rotation of the output of hydraulic motor 76, thus rotating the spindle 36 in the counterclockwise direction for the limited number of revolutions.

Accordingly, it can be seen that the auxiliary spindle drive motor 76 is effective to rotate the spindle 36 for a limited number of revolutions at either high or low torque while the safety barrier 40 is opened to permit workers access to the tools being operated by the spindle 36. Accordingly, tools can be changed and well casing can be set with the safety barrier 40 open, it being understood that the limited number of revolutions of the drilling spindle 36 under such conditions does not permit serious injuries to the workmen in case of an accident.

What is claimed is:

1. Drill rig comprising a support frame, a feed frame mounted on said support frame, a drilling spindle rotatably mounted on said feed frame, an engine mounted on said support frame for driving said spindle, power transmitting means for transmitting power between said engine and said spindle, said power transmitting means including a transmission for connecting and disconnecting a driving connection between said engine and said spindle, an auxiliary drive motor connected to the power transmitting means for driving said spindle when the driving connection between the spindle and the engine is disconnected, an operator-actuated switch for starting and stopping said auxiliary motor, and timer means for limiting operation of said auxiliary motor for a predetermined time period, said time period being of a length sufficient to permit a predetermined number of rotations of the spindle.

2. Drill rig as claimed in claim 1, wherein said power transmitting means includes a drive shaft extending from said transmission, said transmission being shiftable between neutral and a driving gear for connecting and disconnecting said drive shaft from said engine, and means drivingly connecting the auxiliary motor to the drive shaft whereby said auxiliary motor is able to drive said drive shaft when the transmission is in neutral.

3. Drill rig as claimed in claim 1, wherein said auxiliary motor is reversible to drive said spindle in both clockwise and counterclockwise directions.

4. Drill rig as claimed in claim 1, wherein said auxiliary motor is driven hydraulically, and electrically actuated valve means for controlling communication between a source of fluid pressure and said auxiliary motor, said valve means being shiftable between a first condition disconnecting said auxiliary motor from said source, a second condition communicating fluid pressure to said motor to cause said motor to drive said spindle in a clockwise direction, and a third condition communicating fluid pressure to said motor to cause said motor to drive said spindle in a counterclockwise directions.

5. Drill rig as claimed in claim 4, wherein said drivingly connecting means includes a two speed gearbox shiftable between a high speed range and a low speed range, said predetermined time period of said timer permitting about one revolution of said spindle when the gearbox is in the low speed range.

6. Drill rig as claimed in claim 5, wherein said power transmitting means includes a drive shaft extending from the transmission and said drivingly connecting means includes a pulley mounted for rotation with said drive shaft and a belt for driving said pulley.

7. Drill rig as claimed in claim 1, wherein said predetermined time period permits about one revolution of said spindle in low gear (and three in high gear).

8. Drill rig as claimed in claim 1, wherein said drivingly connecting means includes a two speed gearbox shiftable between a high speed range and a low speed range, said predetermined time period of said timer permitting about one revolution of said spindle when the gearbox is in the low speed range.

9. Drill rig comprising a support frame, a feed frame mounted on said support frame, a drilling spindle rotatably mounted on said feed frame, an engine mounted on said support frame for driving said spindle, power transmitting means for transmitting power between said engine and said spindle, said power transmitting means including a transmission for connecting and disconnecting a driving connection between said engine and said spindle, an auxiliary drive motor connected to the power transmitting means for driving said spindle when the driving connection between the spindle and the engine is disconnected, a safety barrier carried by said frame and movable between open and closed positions, said safety barrier in said closed position preventing access to said spindle during drilling, said safety barrier being movable to said open position to permit access to said spindle when said transmission disconnects the driving connection between the engine and the transmission, and control means operable with the safety barrier in the open position to permit said auxiliary drive motor to rotate said spindle for a limited number of revolutions with the safety barrier in the open position.

10. Drill rig as claimed in claim 9, wherein said auxiliary drive motor is connected to the power transmitting means through a two speed gearbox shiftable between a high speed range and a low speed range, said limited number of revolutions being about one revolution when the gearbox is in the low speed range.

11. Drill rig as claimed in claim 9, wherein said control means includes timer means for limiting operation of said auxiliary motor for a predetermined time period.

12. Drill rig as claimed in claim 11, wherein said auxiliary motor is reversible to drive said spindle in both clockwise and counterclockwise directions.

* * * * *